United States Patent [19]

Stetler

[11] 4,352,149

[45] Sep. 28, 1982

[54] SIMULATED RAIN ON A WINDOW PANE PANEL ASSEMBLY

[76] Inventor: Harold O. Stetler, 13066 Avenida Del General, San Diego, Calif. 92129

[21] Appl. No.: 96,768

[22] Filed: Nov. 23, 1979

[51] Int. Cl.[3] ..... F21V 33/00

[52] U.S. Cl. ..... 362/96; 362/125; 362/127; 362/133; 362/234; 362/249; 362/253; 362/318; 362/806; 362/811; 428/13

[58] Field of Search ..... 362/96, 125, 127, 133, 362/318, 234, 811, 249, 253, 806; 428/13

[56] References Cited

U.S. PATENT DOCUMENTS 3,134,129 5/1964 Allen ..... 362/96

3,174,688 3/1965 Chatten ..... 362/96

*Primary Examiner*—Stephen J. Lechert, Jr.

*Attorney, Agent, or Firm*—Charles C. Logan, II

[57] ABSTRACT

A simulated rain on a window pane panel assembly that can be used as a room divider, a head-board for a bed, a window replacement, or a door. It has a minor frame assembly having a pair of vertical side frame members interconnected adjacent their respective bottom ends by a bottom frame member. A pair of clear plastic panels cover the front and rear of the minor frame assembly to form a water tight chamber therebetween. A primary tubular member extends substantially across the width of the minor frame assembly adjacent its top and the primary tubular member is also positioned between the laterally spaced clear plastic panels. A plurality of apertures are formed in the bottom surface of the primary tubular member across its length. A major frame assembly laterally surrounds the minor frame assembly, and it contains shelves, speaker cabinets, a built in psychodelic light system, and a storage area beneath the minor frame assembly. The water pump is located in the storage area and flexible tubing connected between the pump and the primary tubular member. A water evacuation port is formed adjacent the bottom of the water tight chamber and a tube is connected between this port and the water pump. A secondary tubular member extends substantially across the width of the minor frame assembly adjacent its bottom and the tubular member has a plurality of apertures across its length along its top surface. An air pump is located in the storage area and flexible tubing is connected between one end of the secondary tubular member and the air pump.

9 Claims, 3 Drawing Figures

52
29
56
60
54
57
29
28
12
18
16
3
3
14
69
48
42
22
46
44
37
35
46
20
46
32
68

68
22
18
14
26
24
32
12

SIMULATED RAIN ON A WINDOW PANE PANEL ASSEMBLY

BACKGROUND OF THE INVENTION

The invention relates to a decorative panel assembly and more particularly to one that simulates a window pane having rain running down its face that can be designed to function as a room divider, a head-board for a bed, a window replacement, or a door.

In the past decorative panel assemblies have been designed with frames having their front and back covered by panel members made of various materials. Shelves have been built into the panel assemblies along with storage chambers, speaker cabinets, light systems cabinets, etc. To date, however little or no use has been made of panel assemblies having a water chamber that simulates a window pane upon which rain is directed along with the running downwardly therealong of the rain drops. Also lacking has been any attempt to coordinate the sounds the sound of a rain storm along with a simulated display panel giving the appearance of rain striking and running down a window pane.

It is an object of the invention to provide a novel panel assembly that will simulate a window pane having the rain striking its outer surface and running downwardly therealong.

It is also an object of the invention to provide a novel panel assembly that can be used in conjunction with recordings of a rain storm to provide visual effects along with sound effects.

It is also an object of the invention to provide a novel panel assembly that can be designed as a room divider a bed headboard, a door, or a window.

It is an additional object of the invention to provide a novel panel assembly that can be easily assembled.

It is a further object of the invention to provide a novel panel assembly that can be used to produce relaxation and sleep.

SUMMARY OF THE INVENTION

The novel panel assembly has been designed to simulate a window pane having the rain striking its outer surface and running downwardly therealong. Incorporated in the panel assembly are speaker cabinets that may be connected to a tape deck or record player that may be mounted on one of the several shelves of the panel assembly. This allows prerecorded sounds of rain storms to be played while the rain simulating mechanism of the panel assembly is being operated. Additionally an overhead light cabinet has built into it psychodelic light that may be connected to or operate in conjunction with the recordings of the rain storm.

The panel assembly has a minor frame assembly having a pair of laterally spaced vertical side frame members interconnected adjacent their bottom ends by a bottom frame member. A pair of plastic panels cover the front and rear of the minor frame assembly to form a water tight chamber therebetween. A primary tubular member extends substantially across the width of the minor frame assembly adjacent its top and it has a plurality of apertures in its bottom surface across its length. One of the vertical side frame members is tubular and flexible tubing passes upwardly therethrough it and has its one end attached to the end of the primary tubular member. The lower end of this tubing is connected to a water pump that is located in the storage area of the panel assembly beneath the minor frame assembly. A water evacuation port is formed adjacent the bottom of the water tight chamber and flexible tubing is connected between the port and the water pump. A secondary tubular member extends substantially across the width of the minor frame assembly adjacent its bottom and it has a plurality of apertures across its length in its top surface. A flexible tube has one of its ends connected to the secondary tubular member and its opposite ends connected to an air pump positioned in the storage area below the minor frame assembly.

The panel assembly has a major frame assembly that laterally surrounds the minor frame assembly. The major frame assembly is comprised of a plurality of vertical frame members and horizontal frame members that position the minor frame assembly so that it is spaced upwardly from the floor. These recited horizontal and vertical frame members also form shelves and cabinets for the components already indicated as being located in a panel assembly.

When the various systems of the panel assembly are operated, the pump will transfer water upwardly to the top of the minor frame assembly and direct it horizontally through the primary tubular member. The primary tubular member has some of its apertures oriented to spray the water droplets against the inner surfaces of the plastic wall panel members to create the impression of rain striking a window pane and running downwardly therealong. The water that runs down the plastic panels collects at the bottom of the minor frame assembly and is drawn out of the water evacuation port to the pump to be recycled over and over. At the same time the air pump is operating to create bubbles rising upwardly through the water that has accumulated at the bottom of the minor frame assembly. The top of the minor frame assembly is also provided with breathing apertures to allow the air to escape from within the panel assembly into the surrounding atmosphere. If desired, a scented deodorizer may be dropped into the water of the system and the air that passes upwardly out of the minor frame assembly will act to freshen the surrounding atmosphere.

DESCRIPTION OF THE PREFERRED EMBODIMENT

Figure 1:
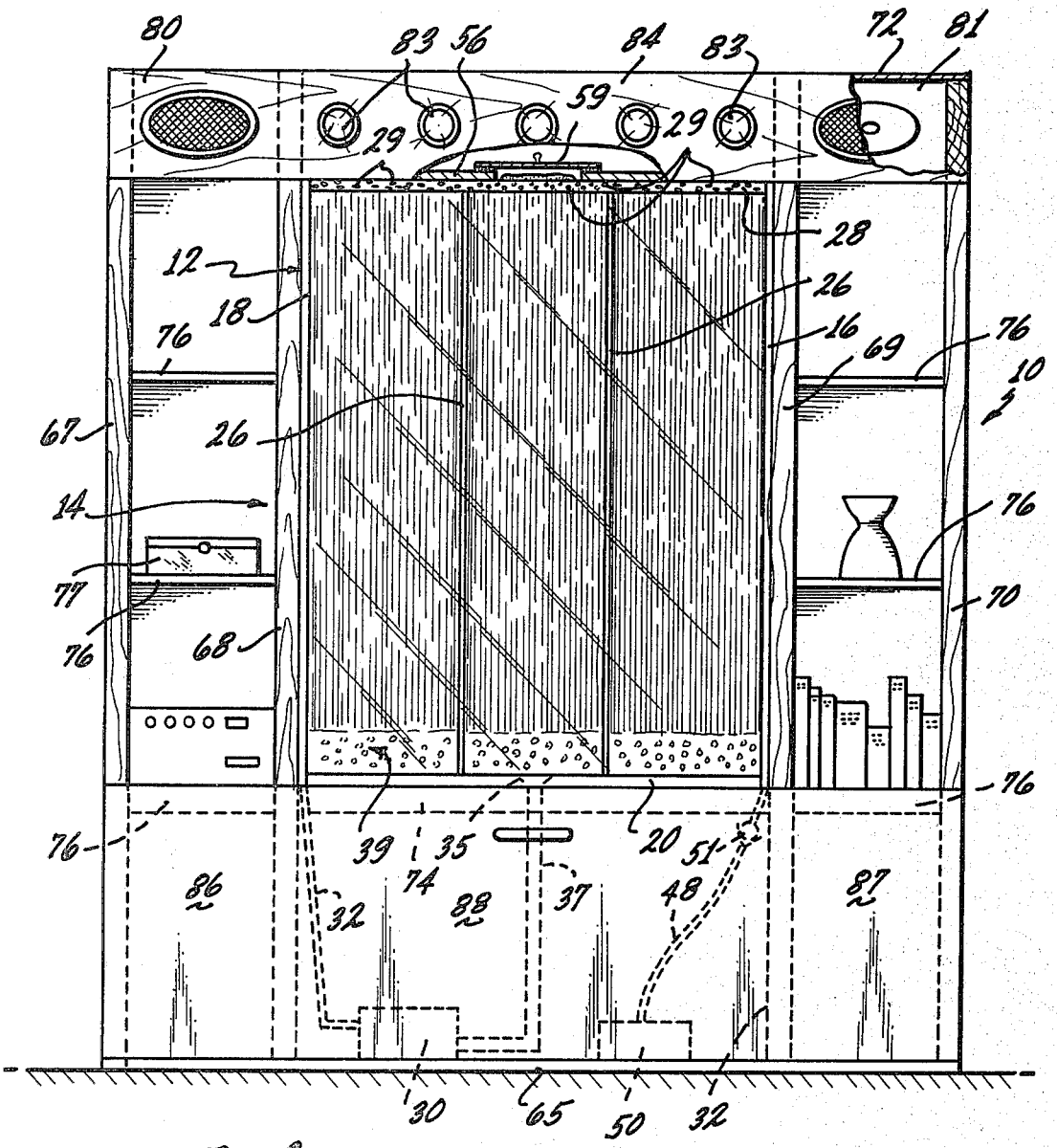
FIG. 1 is a front elevation view of the novel panel assembly.
Figure 4:
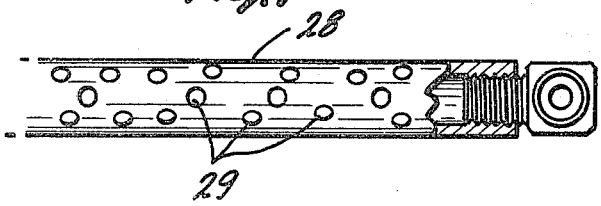
FIG. 4 is a partial bottom view of the primary tubular member.
Figure 5:
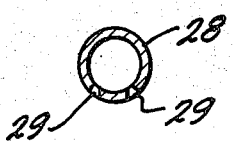
FIG. 5 is a cross sectional elevational view taken along the primary tubular member.
Figure 2:
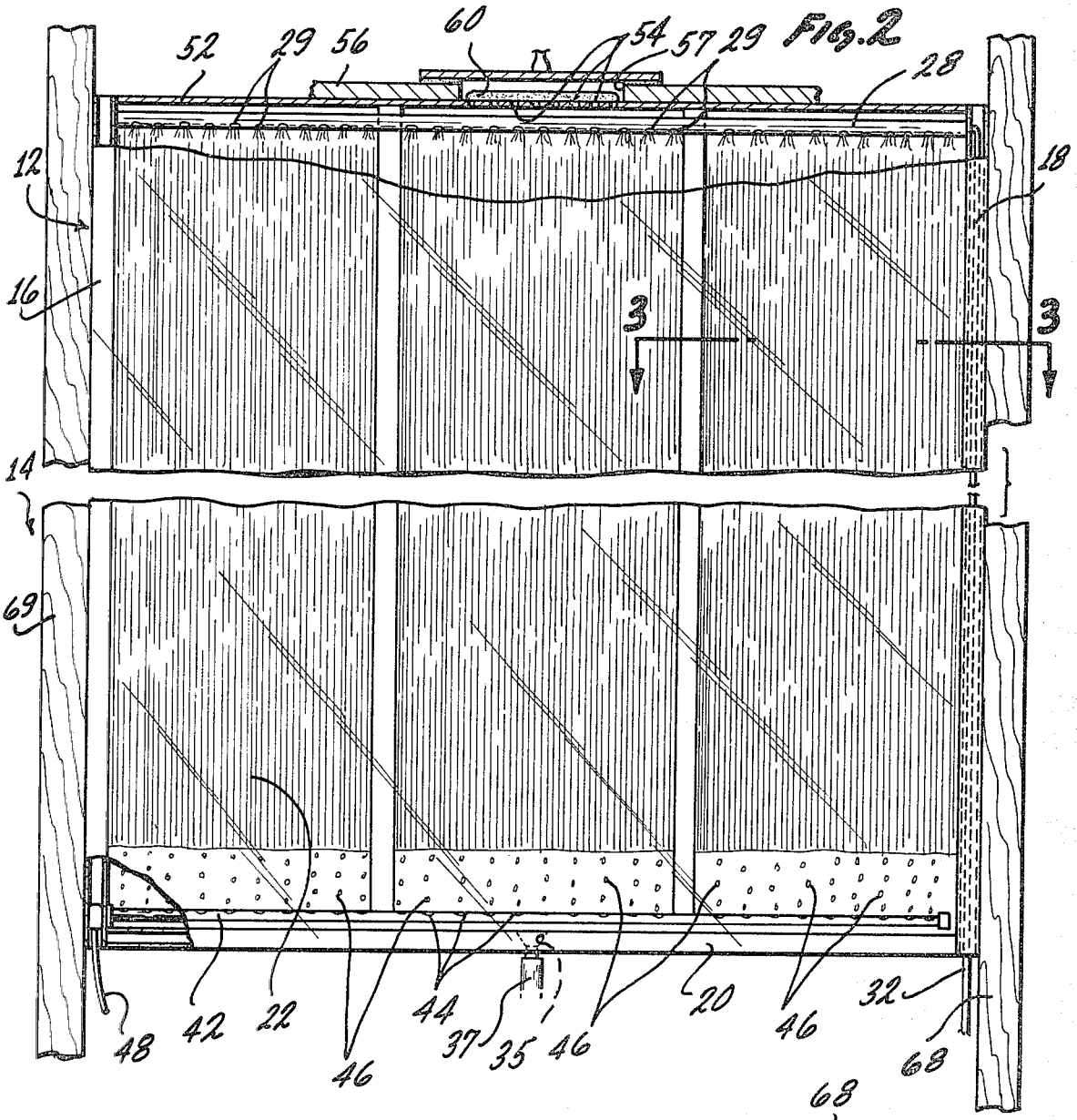
FIG. 2 is a front elevation view of the minor frame assembly illustrating portions broken away for clarity.
Figure 3:
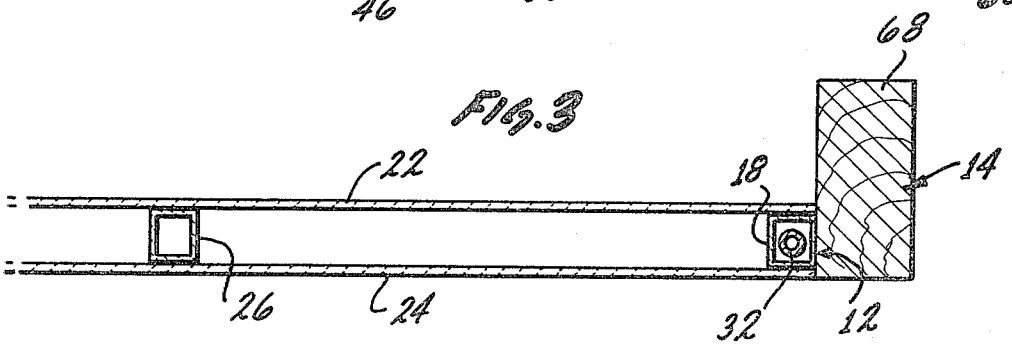
FIG. 3 is a cross-sectional view taken along lines 3—3 of FIG. 2.

The novel simulated rain on a window pane panel assembly will be described by referring to FIGS. 1–5. The panel assembly is generally designated numeral 10. It has a minor frame assembly 12 and a major frame assembly 14.

The minor frame assembly 12 has a pair of laterally spaced vertical side frame members 16 and 18 interconnected adjacent their respective bottom ends by a horizontal bottom frame member 20. A plastic panel 22 covers the front of the minor frame assembly and a plastic panel 24 covers the rear of the minor frame assembly to form a water tight chamber between. The plastic panels may be made of plexiglass or a similar plastic material.

Frame members 16, 18, and 20 have a tubular structure and are also made of plastic material. A plurality of spacer members 26 are laterally spaced across the width of the panel assembly between panels 22 and 24 to add structural strength to the panel assembly.

A primary tubular member 28 extends substantially across the width of the minor frame assembly adjacent its top and it has a plurality of apertures 29 formed in its bottom surface across its length. These apertures 29 are oriented such that water directed from the inside of the primary tubular member will be sprayed onto the sides of the panels 22 and 24 to give the appearance of rain striking a window pane.

A water pump 30 is located in the storage area 32 formed beneath the minor frame assembly by the major frame assembly. A flexible tube member 32 has its one end connected to water pump 30 and its other end passes upwardly through tubular vertical frame member 18 and has its end connected to one end of primary tubular member 28. A water evacuation port 35 is formed adjacent the bottom of the water tight chamber. A flexible tubing member 37 is connected between water evacuation port 35 and water pump 30. The water 39 that accumulates in the bottom of the water tight chamber is thus recycled through the water pump over and over to the primary tubular member 28.

A secondary tubular member 42 extends substantially across the width of the minor frame assembly adjacent its bottom and it has a plurality of apertures 44 along its top surface along its length. One end of secondary tubular member 42 is slightly elevated above the opposite end to aid in release of air bubbles 46 upwardly through water 39 that accumulates in the water tight chamber. Flexible tubing 48 has one end connected to secondary tubular member 42 and its opposite end connected to air pump 50. A check valve 51 is located in flexible tube 48 to prevent water from seeping back into the air pump when it has been shut off.

The top of the minor frame assembly 12 has a horizontal frame member 52 closing it. Air apertures 54 are formed in a portion of frame member 52 to allow for escape of the air that has been pumped upwardly through water 39. A second horizontal frame member 56 has an aperture 57 located above the air apertures 54 and a cover panel 59 closes aperture 57. A vent 60 in the side of cover panel 59 allows the air to escape even when cover panel 59 is in position. To add water to the system, cover panel 59 would be removed and additional water can be poured in. Also if desired a deodorizer can be added in a like manner to produce a scented flow of air that escapes through a vent 60.

The major frame assembly 14 laterally surrounds the minor frame assembly 12 and it has a base platform 65, and a plurality of laterally spaced vertical members 67, 68, 69, and 70 extending upwardly from base 65. Horizontal frame members 56, 72, and 74 extend between the laterally spaced vertical frame members to form a rigid structure. A plurality of shelves 76 are formed in the major frame assembly for supporting a tape deck 77, an am-fm receiver 78 or other items. Speaker cabinets 80 and 81 are located at the top of the major frame assembly and psychodelic lights 83 are located in the overhead light cabinet 84 found located between the respective speaker cabinets. The front of major frame assembly 14 also has front panel members 86 and 87 and a hinged front door panel 88 that can be opened to gain acess to the air pump 50 and water pump 30.

What is claimed is:

1. A simulated rain on a window pane panel assembly for decorative use inside a building comprising a minor frame assembly having a pair of laterally spaced upright side frame members interconnected adjacent their respective bottom ends by a bottom frame member;

a primary tubular member extending substantially across the width of said minor frame assembly adjacent the top of said minor frame assembly;

a first rigid plastic panel covering the front of said minor frame assembly and a second rigid plastic panel covering the rear of said minor frame assembly, said plastic panels being of such a height that they extend from said bottom frame member all the way up to the top of said minor frame to form a water tight chamber therein, all the way up to said primary tubular member;

said primary tubular member also being positioned between said laterally spaced first and second plastic panels, said primary tubular member having a plurality of apertures across its length in its bottom surface, some of the apertures in the bottom of said primary tubular member being oriented to spray water droplets against the inner surfaces of said first and second plastic panel members;

a water pump;

a water evacuation port formed adjacent the bottom of said water tight chamber; and a first tubing member connected between one end of said primary tubular member and said water pump and a second tubing member connected between said water evacuation port and said water pump.

2. A simulated rain on a window pane panel assembly as recited in claim 1, further comprising a plurality of laterally spaced vertical plastic spacer members located between said first and second plastic panel for structurally reinforcing said water tight chamber.

3. A simulated rain on a window pane panel assembly as recited in claim 1, further comprising a secondary tubular member extending substantially across the width of said minor frame assembly adjacent the bottom of said minor frame assembly, said secondary tubular member also being positioned between said laterally spaced first and second plastic panels, said secondary tubular member having a plurality of apertures across its length in its top surface.

4. A simulated rain on a window pane panel assembly as recited in claim 3, further comprising an air pump and a third tubing member connected between one end of said secondary tubular member and said air pump.

5. A simulated rain on a window pane panel assembly as recited in claim 1, further comprising a major frame assembly that laterally surrounds said minor frame assembly, said major frame assembly comprising:

a base, at least two laterally spaced vertical frame members extending upwardly from said base, a horizontal frame member spaced upwardly from said base that extends between said laterally spaced vertical frame members, said horizontal frame member providing support for said minor frame assembly and forming a storage area below it for receiving said water pump.

6. A simulated rain on a window pane panel assembly as recited in claim 5, further comprising a front door panel to cover said storage area.

7. A simulated rain on a window pane panel assembly as recited in claim 5, further comprising shelves built into said major frame assembly adjacent opposite sides of said vertical frame members.

8. A simulated rain on a window pane panel assembly as recited in claim 7 further comprising speaker cabinets built into said major frame assembly.

9. A simulated rain on a window pane panel assembly as recited in claim 7, further comprising a psychedelic light system mounted in said major frame assembly overhead said minor frame assembly.

* * * * *